US006322144B1

(12) United States Patent
Gebhard

(10) Patent No.: US 6,322,144 B1
(45) Date of Patent: Nov. 27, 2001

(54) SEAT SUPPORT FOR REVOLVING CHAIRS

(75) Inventor: Reinhard Gebhard, Sulzbach-Rosenberg (DE)

(73) Assignee: Sifa Sitzfabrik GmbH (DE)

( * ) Notice: Subject to any disclaimer, the term of this patent is extended or adjusted under 35 U.S.C. 154(b) by 0 days.

(21) Appl. No.: 09/147,977

(22) PCT Filed: Jul. 30, 1998

(86) PCT No.: PCT/DE98/02185

§ 371 Date: Mar. 24, 1999

§ 102(e) Date: Mar. 24, 1999

(87) PCT Pub. No.: WO99/08568

PCT Pub. Date: Feb. 25, 1999

(30) Foreign Application Priority Data

Aug. 19, 1997 (DE) ..... 297 14 809 U

(51) Int. Cl.[7] ..... A47C 1/024

(52) U.S. Cl. ..... 297/300.1; 297/301.1; 297/301.7; 297/344.19

(58) Field of Search ..... 297/300.1, 344.19, 297/301.3, 301.7, 292, 301.1

(56) References Cited

U.S. PATENT DOCUMENTS

| | | | | |
|---|---|---|---|---|
| 4,720,142 | * | 1/1988 | Holdredge et al. | 297/301.7 |
| 4,848,837 | * | 7/1989 | Volke | 297/300.1 |
| 5,222,783 | * | 6/1993 | Lai | 297/301.7 X |
| 5,228,748 | * | 7/1993 | Neumuller | 297/300.1 X |
| 5,295,731 | * | 3/1994 | Dauphin | 297/300.1 X |
| 5,318,346 | * | 6/1994 | Roossien et al. | 297/300.1 |
| 5,348,372 | * | 9/1994 | Takamatsu et al. | 297/301.1 X |
| 5,356,200 | * | 10/1994 | Stumpf et al. | 297/301.1 X |
| 5,664,834 | * | 9/1997 | Hsu | 297/300.1 |
| 5,806,930 | * | 9/1998 | Knoblock | 297/300.1 |
| 6,074,008 | * | 6/2000 | Gorgi et al. | 297/344.19 X |
| 6,086,153 | * | 7/2000 | Heidmann et al. | 297/300.1 |
| 6,120,096 | * | 9/2000 | Miotto | 297/300.1 X |

FOREIGN PATENT DOCUMENTS

| | | | | |
|---|---|---|---|---|
| WO 85/00734 | * | 2/1985 | (WO) | 297/300.1 |

* cited by examiner

*Primary Examiner*—Peter M. Cuomo
*Assistant Examiner*—Rodney B. White
(74) *Attorney, Agent, or Firm*—Morrison Law Firm

(57) ABSTRACT

The invention concerns a seat support for revolving chairs, in particular office revolving chairs, comprising a metal body in the shape of a pan, provided with top fixing elements for the seat lower part or seat plate, a bottom part for receiving the conical end of a support post adjustable in height, rear assembling elements for assembling said support to a seat back support and at least a lateral or front sleeve, provided for at least an actuating lever. The pan-shaped metal body has side walls opening obliquely frontwards at least partially into an angle ranging between 20 and 70 relative to the seat support longitudinal median axis, and are joined therein with a front wall. The pan-shaped metal body horizontal transverse section, formed by the side walls and the front wall tapers towards the tub base.

10 Claims, 3 Drawing Sheets

SEAT SUPPORT FOR REVOLVING CHAIRS

The invention pertains to a seat holder with the characteristics of the general concept of claim 1.

Such seat holders for swivel chairs, especially office swivel chairs, consisting of a tub-shaped metal piece with attachment provisions on top for the underside of a seat or a seat plate, a lower receptacle for the conical end of a support column of adjustable height, rear connections for connecting to a holder for a backrest, and at least one side or front passage for at least one operating lever, are known for example from DE-C-34 24 756. This seat holder, which is T-shaped in the top view, has a welded-on conical socket and a welded-on holding element and requires relatively heavy-gauge sheet metal.

The task of the present invention is to create a seat holder of the type named at the beginning, in which sheet metal of the lightest possible gauge can be used, in which welded seams are kept to a minimum and whose assembly is as simple as possible.

This task is solved with the features named in the characterizing part of claim 1. Refinements and advantageous versions of the invention are included in the additional claims.

According to the invention, the tub-shaped metal piece of a seat holder of this type has side walls which are at least partially open obliquely at an angle of between 20° and 70° to the longitudinal center axis of the seat holder toward the front; there they join a front wall, and the horizontal cross section of the tub-shaped metal piece formed by the side walls and the front wall decreases in size toward the bottom of the tub. This design makes it possible to dispense with the welded-on holding element of DE-C-34 24 756, and in addition to achieve high strength by means of creases and edges or rounding in the sheet metal, which allows the thickness of the sheet metal to be reduced.

The receptacle for the conical end of the support column is a conical socket of known type, which is connected to the bottom of the tub at its lower end and which is advantageously held in a higher area by a horizontal reinforcement sheet, with the reinforcement sheet braced in or on the side walls and/or the front wall. It is advantageous for the reinforcing sheet to be clamped to the conical socket, and the reinforcing sheet is clamped, creased, stamped or riveted into the side walls and/or the front wall by means of slits, straps and/or bends.

The connecting elements for the connection with the backrest holder consist in known manner of at least two lateral holes to receive a horizontally positioned transverse pin; the holes can be executed with a deep-drawn reinforcing rim. The attachment provisions for the seat plate or seat consist of at least three horizontally bored holes in projections or tabs of the metal piece.

With the designated design it is possible to produce the tub-shaped metal piece with the attachment or connecting provisions in a single piece.

The holes for the connection with the backrest holder can be strengthened by an insert or the like; preferably this insert is a reinforcement piece with U-shaped cross section inserted transversely between the side walls, whose sides overlap the holes and have holes which are concentric to them.

In the following section the invention will be described in greater detail by way of examples on the basis of drawings. The illustrations show the following:

FIG. 1 a side view of a seat holder.

FIG. 2 a top view of FIG. 1.

Figure 1:
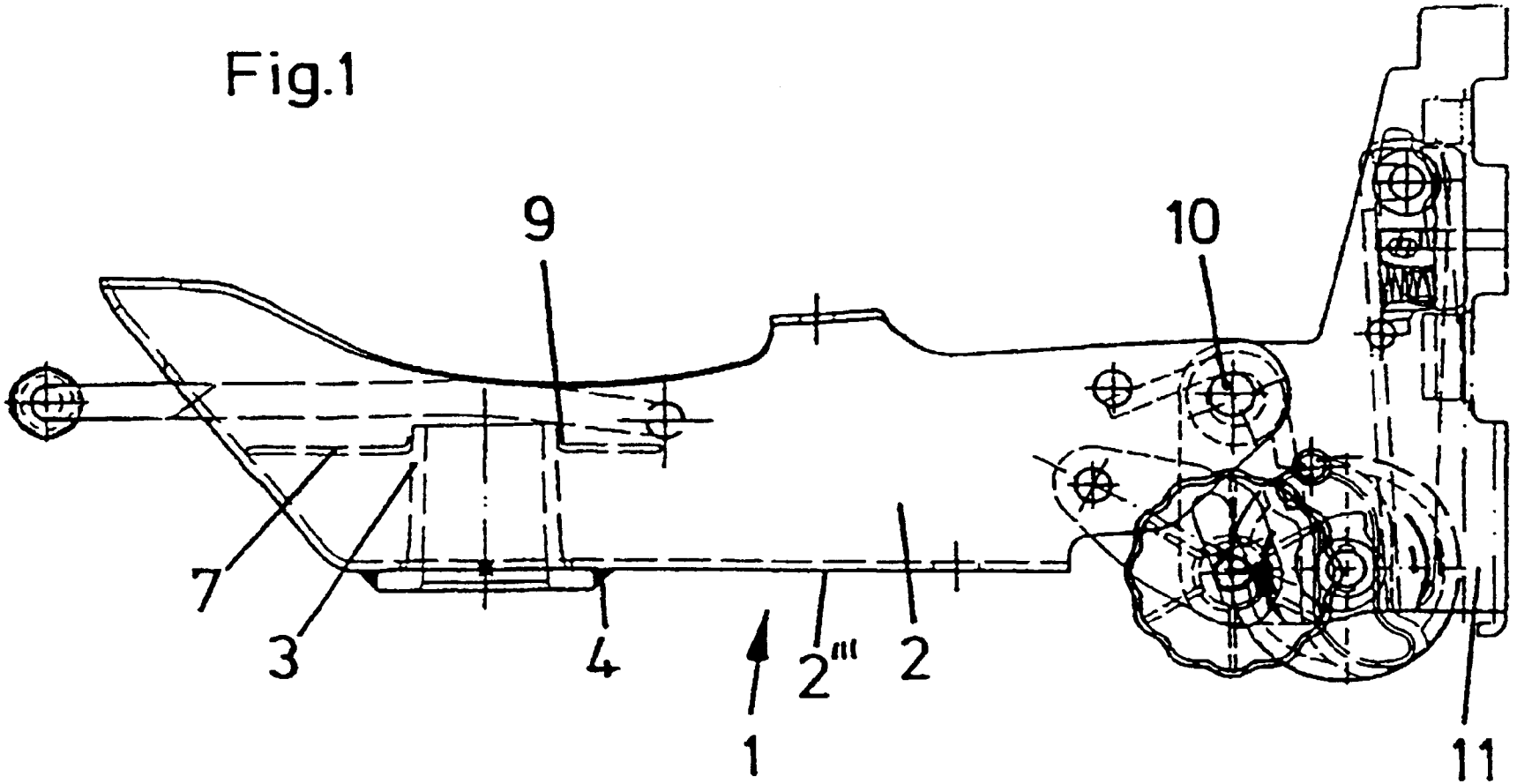
Figure 2:
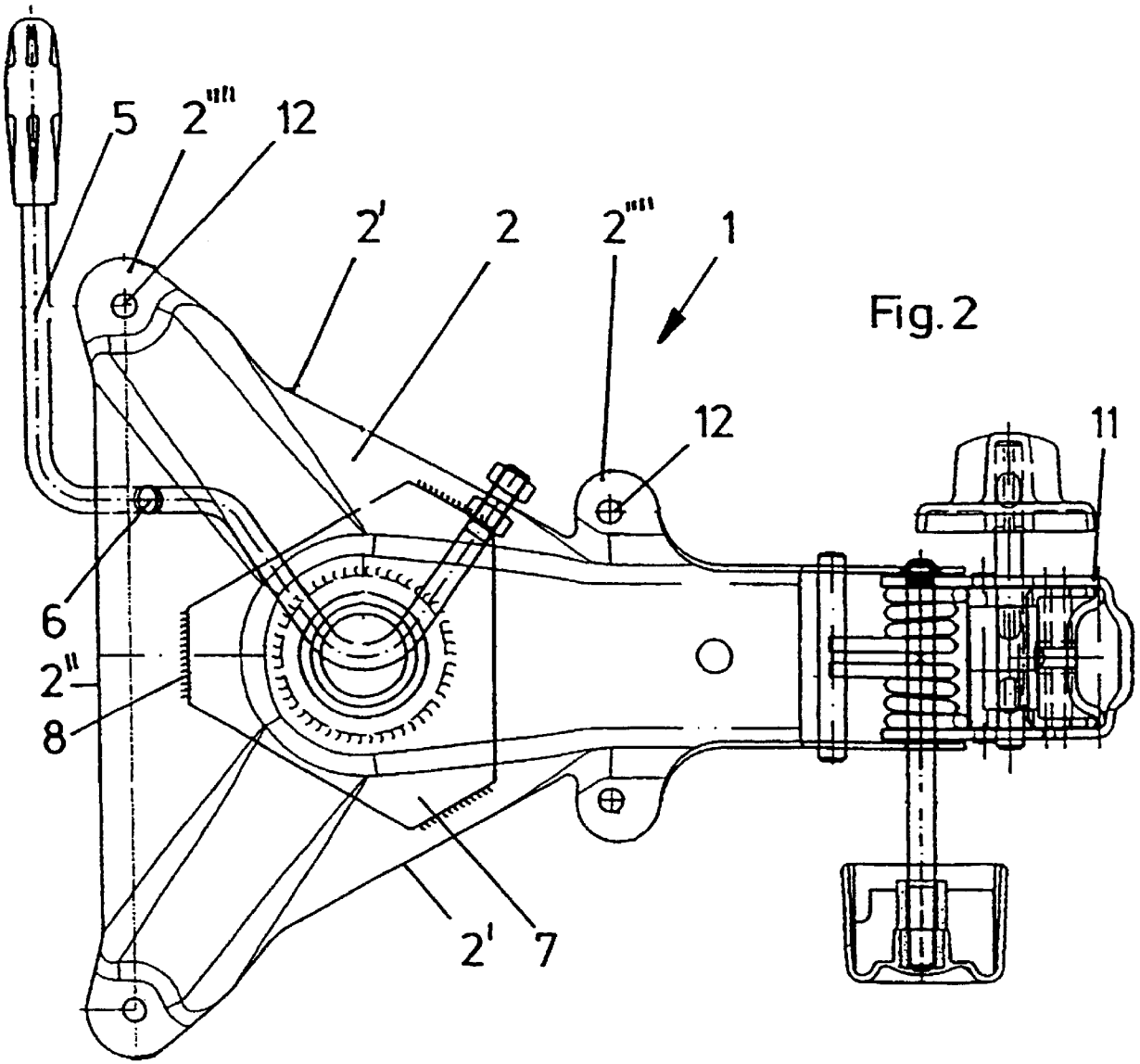
Figure 3:
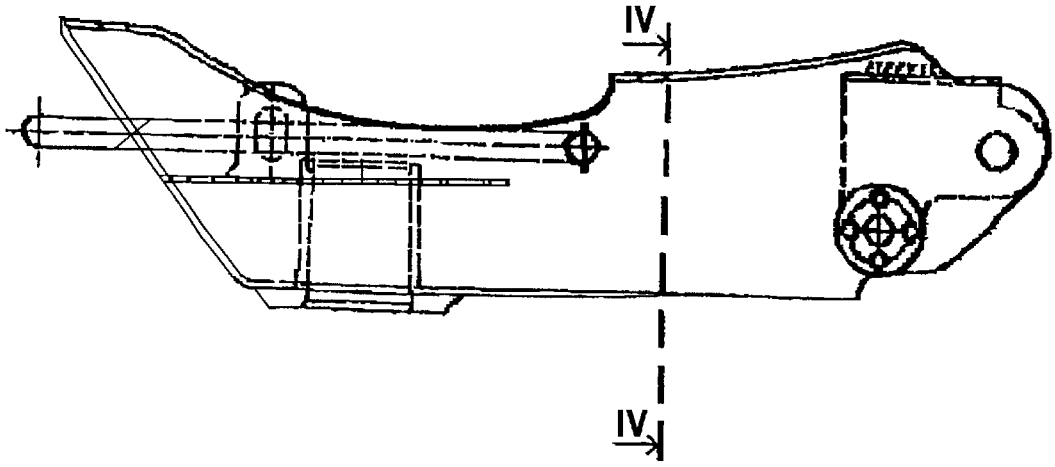
FIG. 3 is a side view of a seat holder.
Figure 4:
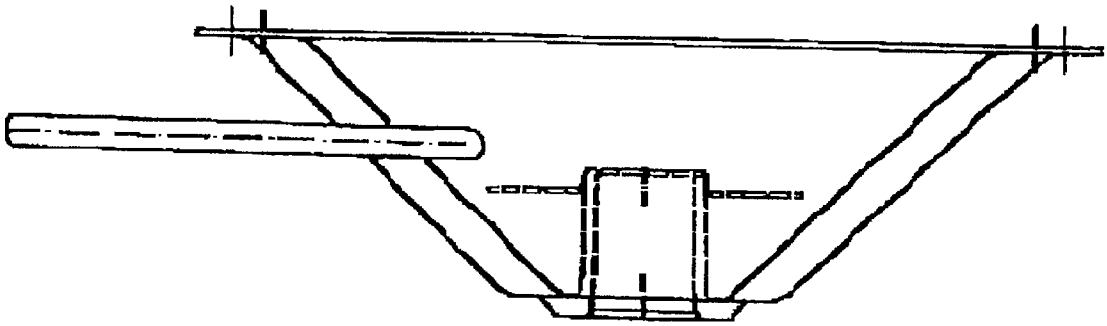
FIG. 4 is a cross-section view of the seat holder of FIG. 3 taken along line IV—IV.

The seat holder 1 in accordance with FIGS. 1 and 2 consists of a tub-shaped metal piece 2 with two side walls 2' which, after a short parallel rear portion, spread outward toward the front at identical angles, and a front wall 2" which connects the latter, so that in the top view the resulting impression is largely that of a triangle. Toward the bottom the side walls 2' and the front wall 2" approach each other obliquely and unite in a horizontal tub floor 2'". The tub floor 2'" has a round opening, into which is inserted a conical socket 3 for receiving a support column, with a flange 4 which makes flat contact under the floor. To stabilize the conical socket 3 there is a horizontal reinforcement sheet 7 inserted between the side walls 2' and the front wall 2" by means of welded seams; this sheet has a round opening for the upper end of the conical socket 3, and holds the latter clamped in a circumferential flange 9 which is directed upward. To activate a release for a gas spring on the support column, a lever 5 is guided outward through a hole 6 in the front wall 2" of the tub-shaped metal piece 2; the lever can rotate in the metal piece, and has a protrusion which can press on the release. For the connection with a seat plate the tub-shaped metal piece 2 has side or front horizontally directed tabs 2"" with attachment holes 12. For the connection to a backrest holder 11 which is swivel-mounted on the parallel rear portion of the seat holder, there are holes 10 in the sidewalls 2", which are aligned coaxially with corresponding holes in the backrest holder and receive a pin or the like.

What is claimed is:

1. Seat holder for swivel chairs, consisting of a tub-shaped metal piece with attachment provisions on top for the underside of a seat or a seat plate, an adjustable-height support column having a conical end, a lower receptacle for the conical end of the adjustable-height support column, rear connectors for the connection to a back rest holder, and at least one opening in at least one of the side or front of the tub-shaped metal piece for at least one operating lever, the tub-shaped metal piece (2) having sidewalls (2') which open at least partially obliquely at an angle to a longitudinal center axis of the seat older (1) of between 20° and 70° toward a front end of the seat holder, where they join a front wall (2"), and that each of the side walls (2') and the front wall (2") taper toward a floor of the tub (2'").

2. Seat holder as in claim 1, characterized by the fact that the receptacle for the conical end of the support column is a conical socket (3) which is connected at its lower end with floor of the tub (2'") and in a higher area is held by a reinforcing sheet (7), with the reinforcing sheet braced in or on at least one of the side walls (2') and the front wall (2").

3. Seat holder as in claim 2, characterized by the fact that the reinforcing sheet (7) is clamped onto the conical socket (3).

4. Seat holder as in claim 2, characterized by the fact that the reinforcing sheet (7) is one of clamped, creased, stamped and riveted into one of the sidewalls and the front wall by means of at least one of slits, straps and bends.

5. Seat holder as in claim 1, characterized by the fact that connection provisions for the connection with the backrest holder (11) consist of at least two horizontally-drilled holes (10) for receiving a horizontally positioned cross-pin.

6. Seat holder as in claim 5, characterized by the fact that the holes are reinforced by means of an insert.

7. Seat holder as in claim 5, characterized by the fact that the insert is a reinforcement piece with a U-shaped cross section inserted transversely between the side walls, whose sides overlap the holes and have reinforcement piece holes which are concentric to the holes.

8. Seat holder as in claim 5, characterized by the fact that the holes are formed with a deep-drawn reinforcement rim.

9. Seat holder as in claim 1, characterized by the fact that the attachment provisions for the seat plate or the seat consist of at least two horizontally drilled holes (12) in tabs (2"") of the metal piece.

10. Seat holder as in claim 1, characterized by the fact that the tub-shaped metal piece is produced in a single piece with the attachment provisions.

* * * * *